United States Patent [19]

Perreault

[11] 4,179,678

[45] Dec. 18, 1979

[54] ELECTRIC FUSE WITH GAS EVOLVING MATERIALS

[75] Inventor: Richard Perreault, Amesbury, Mass.

[73] Assignee: Gould Inc., Rolling Meadows, Ill.

[21] Appl. No.: 894,594

[22] Filed: Apr. 7, 1978

[51] Int. Cl.[2] ..... H01H 85/12

[52] U.S. Cl. ..... 337/293; 337/159; 337/279

[58] Field of Search ..... 337/158, 159, 160, 161, 337/162, 290, 291, 292, 293, 294, 295, 273, 279, 280, 229, 231

[56] References Cited

U.S. PATENT DOCUMENTS

| | | | |
|---|---|---|---|
| 2,964,604 | 12/1960 | Jacobs, Jr. et al. | 337/295 |
| 2,988,620 | 6/1961 | Kozacka | 337/161 |
| 3,020,372 | 2/1962 | Kozacka | 337/293 |
| 3,374,328 | 3/1968 | Cameron | 337/293 |
| 3,394,333 | 7/1968 | Jacobs, Jr. | 337/229 |

*Primary Examiner*—Harold Broome

[57] ABSTRACT

A pair of parallel fusible elements is sub-divided, or separated by points of reduced cross-section into two parallel strings of fusible element sections. The pair of fusible elements is supported by a support of electric insulating material including a portion arranged between the pair of fusible elements and extending in a direction longitudinally thereof. The support further includes transverse arms arranged to both sides of the portion of the support that extends in the direction of the pair of fusible elements. These transverse arms are planar and support said planar fusible element sections and consequently the pair of fusible elements. The arms sandwich the planar fusible element sections which are arranged between the arms. If fusible elements of the above kind are connected in parallel into an electric circuit, the fusible elements will fuse sequentially at low currents at one or more points thereof. This process is often referred-to as "triggering". To expedite arc extinction by gas-blast, gas-evolving materials are arranged at points where break formation is likely to occur. The gas-evolving materials are locked in position between the pair of fusible elements and said support therefor.

7 Claims, 9 Drawing Figures

R1
R2

ELECTRIC FUSE WITH GAS EVOLVING MATERIALS

BACKGROUND OF THE INVENTION

U.S. Pat. No. 3,394,333 to P. C. Jacobs, Jr., July 23, 1968 for ELECTRIC FUSE HAVING STRESS-REDUCING FUSE LINK MEANS discloses a fuse link, or fusible element, for low voltage fuses that has the ability of withstanding a high number of repetitive cycles. The crux of the fusible element of Jacobs lies in its particular geometry. The patent application of P. C. Jacobs, Jr., Ser. No. 886,034 filed 03/14/78 for FUSIBLE ELEMENT FOR ELECTRICAL FUSES HAVING A RELATIVELY HIGH VOLTAGE RATING AND A RELATIVELY HIGH CYCLING PERFORMANCE describes a fusible element and a support therefor based on the teachings of his earlier patent, but adapted for relatively high voltage ratings, e.g. 2–8 kilovolts.

The present invention uses the teachings of the above patent application of P. C. Jacobs, Jr. and provides particularly effective means having great dimensional stability for the production of arc-extinguishing blasts of gas when interrupting currents of relatively small magnitude.

SUMMARY OF THE INVENTION

A fusible element and a support thereof according to the present invention comprise a pair of parallel fusible elements each including a plurality of fusible element sections separated from each other by points of reduced cross-section.

Said plurality of fusible element sections of each of said pair of fusible elements include bent sections having perforations in spaced relation from the bent edges thereof, and said plurality of fusible element sections of said pair of fusible elements also include planar fusible element sections.

Said pair of parallel fusible elements is supported by a support of electric insulating material. Said support includes a portion arranged between said pair of fusible elements and extending in a direction longitudinally of said pair of fusible elements. Said support further includes arms arranged to both sides of the above referred-to portion of the support, sandwiching said planar fusible element sections, and supporting said planar fusible element sections.

Fuses embodying the present invention further include at least one member of a gas-evolving substance which member is wedge-shaped on one side thereof and projects with said wedge-shaped side into the angular spaces formed by the bents in one pair of said bent element sections. Said gas-evolving member abuts with the center of the side thereof opposite said wedge-shaped side against said portion of said support that extends in a direction longitudinally of said pair of fusible elements.

DESCRIPTION OF PREFERRED EMBODIMENT

Figures 1, 2, 3, 4, 5A, 5B, 5C:
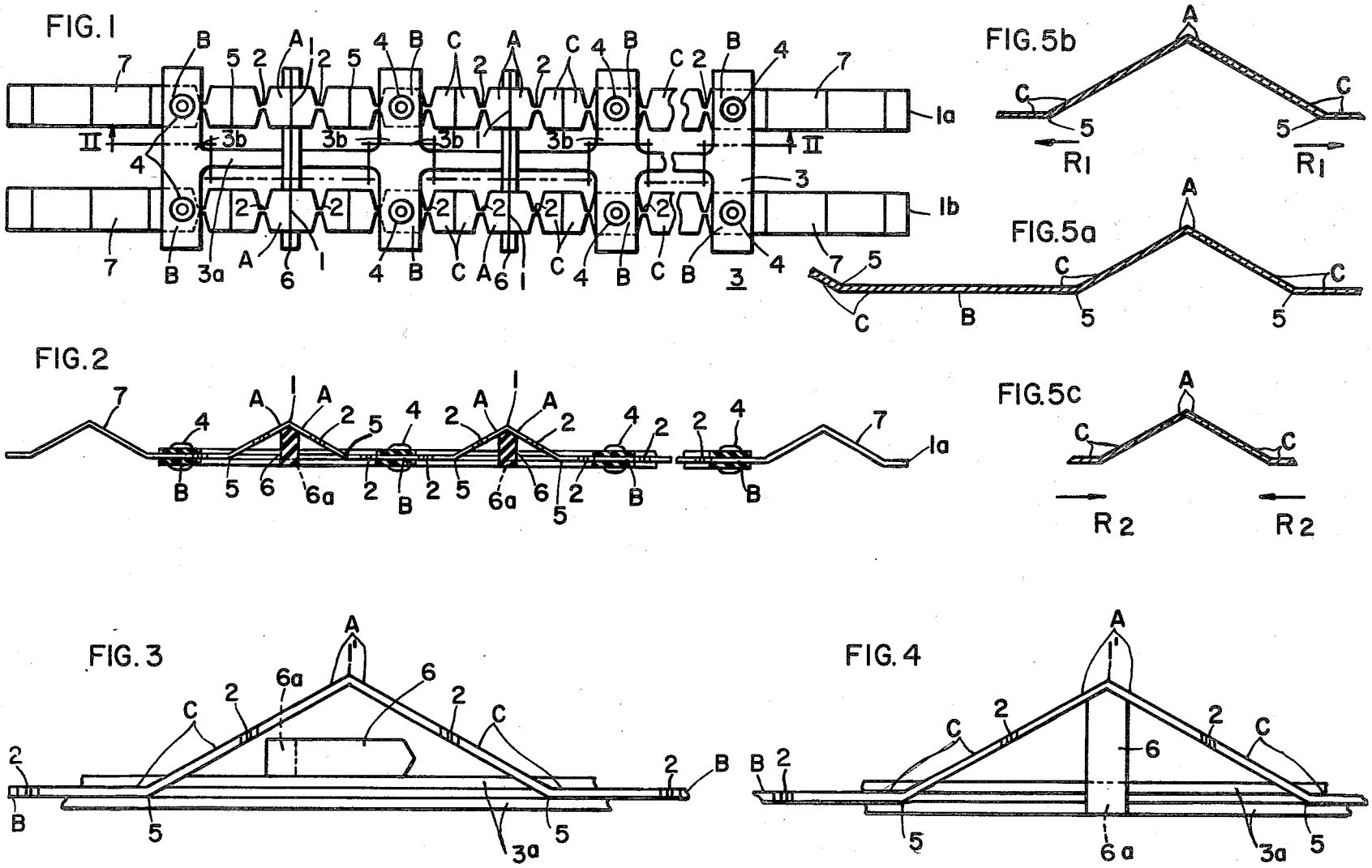
FIG. 1 is a diagrammatic top plan view of a pair of fusible elements and of a support therefor embodying the present invention.
FIG. 2 is a section of the structure shown in FIG. 1, taken along II—II of FIG. 1.
FIG. 3 and FIG. 4 show in side view steps in manufacturing fusible elements and their support embodying the present invention.
FIGS. 5*a*,5*b* and 5*c* show diagrammatically a longitudinal section of the behaviour of a fusible element under thermal stresses.

Referring now to the drawing, numerals 1*a* and 1*b* have been applied to indicate a pair of parallel fusible elements, preferably of sheet silver. Elements 1*a* and 1*b* include a plurality of element sections A,B,C and a plurality of equidistant points of reduced cross-section 2. The fusible element sections A are angularly bent to form an edge at 1, and said points of reduced cross-section 2 are arranged remote from, or spaced from, edge 1. The fusible element sections A, or the first fusible element sections A, are roof-shaped, or bent convexly. The points 2 of reduced cross-section are spaced from edge 1 and reduce the cross-section of fusible elements 1*a* and 1*b* equally.

The fusible element sections of which the fusible elements 1*a* and 1*b* are made up further include the fusible element sections B, or second fusible element sections B, that are planar and arranged in spaced relation from said first fusible element sections A.

Reference character 3 has been applied to generally indicate a support of electric insulating material, e.g. a laminate of glass cloth and a synthetic resin. Support 3 includes a portion 3*a* arranged between fusible elements 1*a* and 1*b* and extending in a direction longitudinally of the pair of fusible elements. Support 3 further includes transverse arms 3*b* arranged to both sides of said portion 3*a* of said support 3 and coextensive with said second or planar fusible element sections B, and supporting fusible element sections B. Eyelets or like fasteners 4 project through sections B and arms 3*b*.

Reference character C has been applied to indicate a plurality of fusible element sections bent concavely to form edges 5. The points of reduced cross-section 2 are arranged remote, or spaced from edges 5. Fusible element sections C, or third fusible sections C, conductively interconnect said first fusible element sections A and said second fusible element sections B.

Reference numeral 6 has been applied to designate one or more rods of a material that evolves gas under the action of electric arcs. Rod or rods 6 are arranged transversely to the portion 3*a* of fusible element support 3. Rod or rods 6 are supported adjacent the center or centers thereof by portion 3*a* of support 3, and support with the outer ends thereof a pair of said first fusible element sections A. Thus rod or rods 6 are firmly positioned, or clamped, between parts A and 3*a*. The side of rod or rods 6 adjacent the convex portion of first fusible element sections A is convex, or wedge-shaped, which greatly increases the fit of parts 6 and A, and the dimensional stability of the structure. p Preferably rod or rods 6 of a gas-evolving material are provided at the side or sides thereof opposite their wedge-shaped side, or sides, with a groove 6*a* engaged by the portion 3*a* of support 3 that extends in a direction longitudinally of fusible elements 1*a* and 1*b*.

Figure 6:
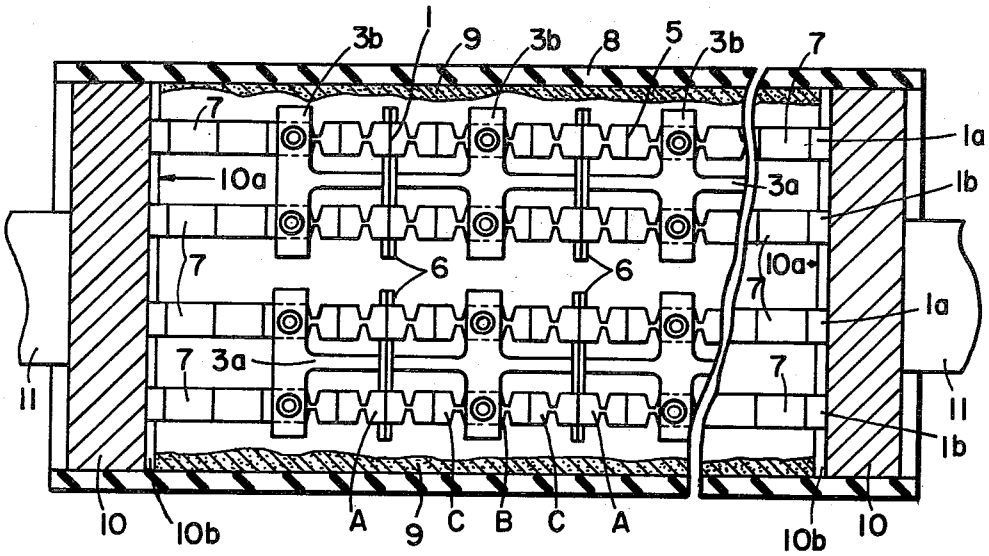
FIG. 6 shows in longitudinal section a fuse embodying the present invention, the fuse being broken in the center region which has been deleted.

FIGS. 1 and 2 show bent ends 7 of fusible elements 1*a* and 1*b* intended to increase the flexibility thereof. These ends are also shown in FIG. 6.

It will be apparent from FIG. 2 that the fusible element 1*a* shown therein comprises a plurality of sections A,B,C which are identical, except that sections A and C each include a bent edge 1 and 5, respectively, while sections B are planar. Sections A are separated from sections C by points of reduced cross-section 2, and sections B and C are separated from each other by points of reduced cross-section 2. The spacing of all points of reduced cross-section 2 between the two axially outermost points of reduced cross-section 2 is equal, i.e. points 2 are spaced equidistantly. As a result of this configuration the fusible elements 1*a*, 1*b* are formed of sections A,B and C which are identical prior to bending at edges 1 and 5.

Another way of looking at the structure of FIG. 2 is to distinguish between first fusible element sections which are situated between two contiguous edges 5 and have an edge 1, and second fusible element sections of which each is planar and arranged contiguously to opposite sides of said first fusible element sections. The edges 1 and 5 are uninterrupted by points of reduced cross-section 2 and the points of reduced cross-section 2 are situated to both sides of edges 1 and 5.

FIGS. 3 and 4 show the mounting, or positioning, of rods 6 of gas-evolving material. As shown in FIG. 3, rods 6 are inserted between parts A and 3*a* without engaging either of those two parts. Then rods 6 are tilted or turned 90 degrees so that their wedge-shaped ends project into the angular space formed by the bent portion of fusible element sections A, and their groove 6*a* is engaged by portion 3*a* of support 3. Hence rods 6 are clamped between parts A and 3*a*, and groove or grooves 6*a* preclude any rotary motions of rods 6 around the points of engagement of grooves 6*a* and part 3*a*.

It will be apparent from FIGS. 2,3 and 4 that parts 3*a* and 3*b* are formed by a pair of flat plates of insulating material, preferably a laminate of glass-cloth and malamine resin between which ribbon fuse links 1*a* and 1*b* are sandwiched. At the points where planar fusible element sections B are covered by, or sandwiched between, arms 3*b*, no arc-extinguishing filler can get access to the fusible element sections B. Hence the arc that takes their place is less effectively quenched than the arc that takes the place of exposed fusible element sections A and B upon blowing of the fuse. This reduction of the arc-quenching action of the filler on fusible element sections B reduces the rate of rise of the arc voltage, and thus tends to limit voltage surges incident to blowing of the fuse. This teaching was first disclosed in U.S. Pat. No. 2,964,604 to P. C. Jacobs et al, Dec. 13, 1960 for CURRENT-LIMITING FUSES HAVING COMPOUND ARC-VOLTAGE GENERATING MEANS.

FIGS. 5*a*–5*c* illustrate the teaching of the above referred-to U.S. Pat. No. 3,394,333 to P. C. Jacobs, Jr. which is applied in the present invention. FIG. 5*a* shows the fusible element in a condition of no thermal stress, or minimal thermal stress, which may also be referred to as the normal condition thereof. This is the condition prevailing at room temperature. FIG. 5*b* shows the fusible element of FIG. 5*a* in a cooler state indicated by arrows $R_1$, and FIG. 5*c* shows the fusible element of FIG. 5 in a warmer state indicated by the arrows $R_2$. It is apparent from FIGS. 5*a* and 5*b* that the planar sections B and the planar portions of sections C encounter minimal resistance on thermal elongation or expansion and on thermal contraction of the fusible element. It will be understood that the fusible elements shown in FIGS. 5*a*–5*c* and also those shown in FIGS. 1,2,3 and 4 are supposed to be submersed in a pulverulent arc-quenching filler as shown in FIGS. 6 and 7.

Referring now to FIG. 6, numeral 8 has been applied to indicate a tubular casing of electric insulating material filled with a pulverulent arc-quenching filler 9, e.g. quartz sand. Filler 9 has been diagrammatically indicated only at its interface with casing 8 while, actually, the entire casing 8 is filled—where not occupied by parts 1*a*, 1*b*,3 and 4—with arc-quenching filler 9. The ends of casing 8 are plugged by terminal plug contacts 10 provided with blades 11. The axially inner end surfaces 10*a* of terminal plugs 10 are provided with grooves 10*b* into which the ends 7 of fusible elements 1*a* and 1*b* are inserted.

The present invention seeks to improve the operation of electric fuses at relatively small overload currents. To this end a relatively large mass of gas-evolving material is arranged immediately adjacent the arc path. The operation of the fuse depends upon the amount of gas-evolving material that is arranged near the arc path as set forth below.

Figure 7:
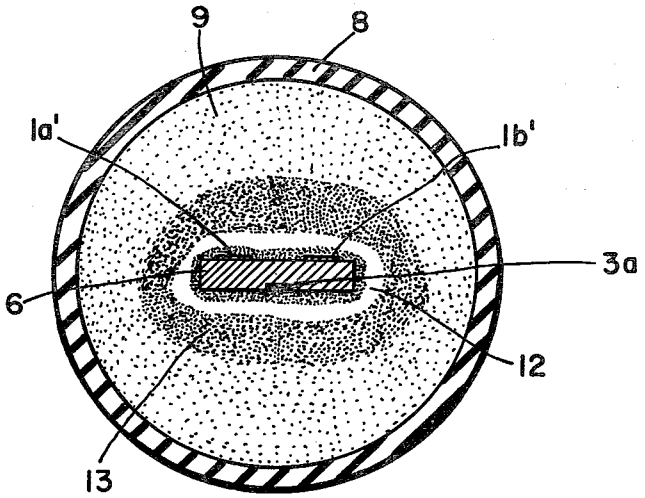
FIG. 7 is a cross-section of a fuse including but a pair of fusible elements after blowing thereof.

The operation of the fuse according the the present invention or, to be more specific, one of its possible modes of operation, is illustrated in FIG. 7.

As shown in that figure the fuse has blown. Casing 8 is filled with an inorganic pulverulent arc-quenching filler 9 such as quartz-sand. The fusible elements 1*a* and 1*b* have been replaced by hollow fulgurites to which reference numerals 1*a*′ and 1*b*′ have been applied. Rods 6 are present, though their volume has decreased by gas evolution. Rod 6 and fusible element support 3 have been entirely covered by a fulgurite indicated by dense stippling. Then follows in radial outward direction a cavity 12 which is essentially a gas-filled space. Further in outward direction follows a fulgurite-like structure of sand particles which adhere to each other. They do not adhere to each other by melting or sintering of quartz particles, nor by condensation of metal vapors upon their surface, but by gas evolution from rod, or rods, 6 and subsequent condensation of that gas on the particles of quartz sand. In the tests under consideration the support 3 and its constituent parts 3*a*,3*b* were of a laminate of glass-cloth and melamine resin and rods 6 had also a large content of melamine. The melamine evolved from parts 3*a*,3*b* plus the malamine evolved from rods 6 evolved long prior to the blowing of the fuse and was precipitated in the relatively cool region designated by reference character 13. There the nitrogen content of melamine was helpful in quenching the arc when the fuse blew. It is thus apparent that formation of body 13 and blowing of the fuse may be events which take place sequentially.

Rods 6 may consist of any desired gas-evolving arc-quenching substance. Particularly good results may be obtained with mixtures of melamine resins and hydrates, or oxides, of aluminum, particularly alumina trihydrate. Such aqueous dispersions of alumina hydrates evolve water or steam under the action of arcs that is likewise helpful in arc extinction and circuit interruption.

I claim as my invention:

1. Fusible elements and a support therefor comprising (a) a pair of parallel fusible ribbon elements each including a plurality of fusible element sections and a plurality of points of reduced cross-section;

(b) said plurality of fusible element sections of each of said pair of fusible elements including angularly bent sections having a point of reduced cross-section arranged in spaced relation from the edge formed by said angular bent, and said plurality of fusible element sections of each of said fusible elements further including non-bent planar sections;

(c) a support of electric insulating material for said pair of fusible elements, said support including a portion arranged between said pair of fusible elements and extending in a direction longitudinally thereof, and said support further including transverse arms arranged to both sides of said portion of said support extending in a direction longitudinally of said fusible elements, said arms sandwiching said planar sections and supporting said planar sections; and (d) a member of a gas-evolving substance being wedge-shaped on one side thereof and engaging with said wedge-shaped side thereof a pair of said angularly bent sections, the center region of said member of a gas-evolving substance opposite said wedge-shaped side thereof abutting against said portion of said support extending in a direction longitudinally of said pair of fusible elements.

2. Fusible elements and a support therefor as specified in claim 1 wherein said member of gas-evolving material is provided at the side thereof opposite said wedge-shaped side with a groove engaged by said portion of said support extending in a direction longitudinally of said pair of fusible elements.

3. Fusible elements and a support therefor as specified in claim 2 wherein a plurality of members of a gas-evolving substance is wedged between different of said angularly bent sections of said pair of fusible elements and said portion of said support extending in a direction longitudinally of said pair of fusible elements.

4. Fusible elements and a support therefor comprising (a) a pair of fusible elements each including a plurality of element sections and equidistant points of equally reduced cross-section;

(b) said plurality of fusible elements including first fusible element sections each bent convexly to form an edge, said points of reduced cross-section being arranged remote from said edge;

(c) said plurality of fusible element sections further including second fusible element sections that are planar and arranged in spaced relation from said first fusible element sections;

(d) a support of electric insulating material for said pair of fusible elements including a portion arranged between said pair of fusible elements, extending in a direction longitudinally of said pair of fusible elements, and transverse arms arranged to both sides of said portion of said support, sandwiching said second fusible element sections and supporting said second fusible element sections;

said plurality of fusible element sections further including third fusible element sections bent concavely to form an edge and said points of reduced cross-section being arranged remote from said edge, said third fusible element sections conductively interconnecting said first fusible element sections and said second fusible element sections; and (f) a rod of gas-evolving material arranged transversely to said portion of said support extending in a direction longitudinally of said pair of fusible elements, said rod being supported adjacent the center thereof by said portion of said support extending in a direction longitudinally of said fusible element and supporting with the outer ends thereof a pair of said first fusible element sections.

5. Fusible elements and a support therefor as specified in claim 4 wherein a plurality of rods of a gas-evolving material is arranged transversely to said portion of said support extending in a direction longitudinally of said fusible elements, each of said plurality of rods engaging with one side thereof a pair of said first fusible element sections and each of said plurality of rods having a groove at the opposite side thereof engaged by said portion of said support extending in a direction longitudinally of said fusible elements.

6. Fusible elements and a support therefor as specified in claim 5 wherein each of said plurality of rods is wedge-shaped at the side thereof opposite to the side which is provided with a groove.

7. Fusible elements and a support therefor comprising (a) a pair of spatially parallel fusible elements in form of metal ribbons;

(b) each of said pair of fusible elements comprising a plurality of spaced pairs of first fusible element sections bent to form a plurality of first edges, said first edges being uninterrupted by points of reduced cross-section and points of reduced cross-section being situated to both sides of and in spaced relation from said first edges;

(c) each of said pair of fusible elements further comprising a plurality of second fusible element sections, said second fusible element sections being planar and each arranged contiguously to opposite sides of one of said first fusible element sections, said first fusible element sections and said second fusible element sections being angularly related to form second edges at the locii of intersections of the planes thereof, said second edges being uninterrupted by points of reduced cross-section and points of reduced cross-section being situated to both sides of and in spaced relation from said second edge;

(d) a planar support of gas-evolving electric insulating material for said pair of fusible elements arranged in parallel relation to said pair of fusible elements;

(e) fasteners affixing said second fusible element sections to said support; and (f) at least one rod of a material evolving gas under the action of electric arcs arranged transversely to said pair of fusible elements, one side of said rod engaging said first fusible element sections and the opposite side of said rod engaging said support.

* * * * *